US011539154B2

(12) United States Patent
Horning et al.

(10) Patent No.: US 11,539,154 B2
(45) Date of Patent: Dec. 27, 2022

(54) POWER CONTACT FOR ELECTRICAL CONNECTOR

(71) Applicant: TE Connectivity Services GmbH, Schaffhausen (CH)

(72) Inventors: Michael James Horning, Landisville, PA (US); Douglas Edward Shirk, Elizabethtown, PA (US); Howard Wallace Andrews, Jr., Hummelstown, PA (US)

(73) Assignee: TE CONNECTIVITY SOLUTIONS GMBH, Schaffhausen (CH)

( * ) Notice: Subject to any disclaimer, the term of this patent is extended or adjusted under 35 U.S.C. 154(b) by 99 days.

(21) Appl. No.: 16/934,313

(22) Filed: Jul. 21, 2020

(65) Prior Publication Data

US 2022/0029333 A1 Jan. 27, 2022

(51) Int. Cl.

| | |
|---|---|
| ***H01R 13/11*** | (2006.01) |
| ***H01R 12/70*** | (2011.01) |
| ***H01R 12/72*** | (2011.01) |
| ***H01R 13/24*** | (2006.01) |
| ***H01R 12/73*** | (2011.01) |
| ***H01R 13/15*** | (2006.01) |
| ***H01R 13/05*** | (2006.01) |

(52) U.S. Cl.

CPC ..... *H01R 13/113* (2013.01); *H01R 12/721* (2013.01); *H01R 12/727* (2013.01); *H01R 12/73* (2013.01); *H01R 13/05* (2013.01); *H01R 13/2407* (2013.01); *H01R 12/7082* (2013.01); *H01R 13/15* (2013.01)

(58) Field of Classification Search

CPC ..... Y10S 439/907; H01R 12/585; H01R 12/7088; H01R 12/724; H01R 12/737; H01R 13/112; H01R 13/113; H01R 4/2433; H01R 12/58; H01R 12/716; H01R 13/111; H01R 13/514; H01R 25/162; H01R 31/02; H01R 9/2416; H01R 12/53; H01R 12/52; H01R 12/515; H01R 12/712; H01R 12/722; H01R 12/727; H01R 13/04

See application file for complete search history.

(56) References Cited

U.S. PATENT DOCUMENTS

| | | | | |
|---|---|---|---|---|
| 3,596,235 A * | 7/1971 | Teurlings | ..... | H01R 13/112 439/748 |
| 4,322,120 A * | 3/1982 | Rilling | ..... | H01R 12/716 439/631 |
| 4,824,380 A * | 4/1989 | Matthews | ..... | H01R 12/58 439/176 |

(Continued)

*Primary Examiner* — Renee S Luebke

(57) ABSTRACT

An electrical connector includes a connector housing having a mating end configured to be mated with a mating connector and a mounting end configured to be mounted to a circuit board. The connector housing includes a receptacle at the mating end receiving the mating connector. The electrical connector includes power contacts held by the connector housing extending between a mating end having a power-in contact interface configured to be coupled to the mating connector and a terminating end having a power-out circuit board interface configured to be coupled to the circuit board. Each power contact includes a power take-off between the mating end and the terminating end having a power-out cable plug interface configured to be electrically connected to a cable plug.

16 Claims, 4 Drawing Sheets

(56) References Cited

U.S. PATENT DOCUMENTS

| | | | | |
|---|---|---|---|---|
| 6,322,377 | B2 * | 11/2001 | Middlehurst | H01R 13/113 439/79 |
| 6,780,027 | B2 * | 8/2004 | Allison | H01R 12/727 439/507 |
| 6,848,950 | B2 * | 2/2005 | Allison | H01R 12/75 439/682 |
| RE41,283 | E * | 4/2010 | Evans | H01R 13/44 439/680 |
| 7,726,982 | B2 * | 6/2010 | Ngo | H01R 12/737 439/79 |
| 7,976,317 | B2 * | 7/2011 | Patel | H01R 12/7088 439/79 |
| 8,057,266 | B1 * | 11/2011 | Roitberg | H01R 12/724 439/682 |
| 8,262,395 | B2 * | 9/2012 | Ke | H01R 13/11 439/79 |
| 8,690,589 | B2 * | 4/2014 | Ngo | H01R 12/7052 439/79 |
| 10,424,887 | B2 * | 9/2019 | Hirschman | H01R 25/162 |
| 10,741,945 | B2 * | 8/2020 | Brungard | H01R 12/7088 |

* cited by examiner

POWER CONTACT FOR ELECTRICAL CONNECTOR

BACKGROUND OF THE INVENTION

The subject matter herein relates generally to electrical connector assemblies.

Electrical connectors are used to electrically connect a circuit board with peripheral or remote devices. Some systems use power connectors to supply power to the circuit board for powering components mounted to the circuit board. For example, the power connector is mounted to the circuit board and a mating power connector is plugged onto the power connector to transfer power to the circuit board. Some known systems require power for peripheral devices, which may be mounted to the circuit board or located remote from the circuit board. The power supplied to the circuit board is routed to a secondary power connector to supply power to the peripheral device. However, the additional power connectors mounted to the circuit board occupy valuable space on the circuit board, increasing the overall size of the circuit board or reducing the number of components that may be mounted to the circuit board.

A need remains for an electrical connector assembly that supplies power to a circuit board and peripheral devices in a cost effective and reliable manner.

BRIEF DESCRIPTION OF THE INVENTION

In one embodiment, an electrical connector is provided. The electrical connector includes a connector housing having a mating end and a mounting end. The mating end is configured to be mated with a mating connector. The mounting end is configured to be mounted to a circuit board. The connector housing includes a receptacle at the mating end configured to receive the mating connector. The electrical connector includes power contacts held by the connector housing. Each power contact extends between a mating end and a terminating end. The mating end includes a power-in contact interface configured to be coupled to the mating connector. The terminating end includes a power-out circuit board interface configured to be coupled to the circuit board. Each power contact includes a power take-off between the mating end and the terminating end. The power take-off includes a power-out cable plug interface configured to be electrically connected to a cable plug.

In another embodiment, a power contact for an electrical connector is provided. The power contact includes a main body extending between a mating end and a terminating end of the power contact. The power contact includes spring beams at the mating end. Each spring beam includes a power-in contact interface configured to be coupled to a mating power contact of a mating connector. The spring beams being independently deflectable. The power contact includes contact tails at the terminating end. Each contact tail includes a power-out circuit board interface configured to be coupled to a circuit board. The power contact includes a power take-off tab extending from the main body. The power take-off tab includes a power-out cable plug interface being a separable interface configured to be electrically connected to a power take-off terminal of a cable plug. A first power path is defined through the main body between the power-in contact interface and the power-out circuit board interface and a second power path is defined through the main body between the power-in contact interface and the power-out cable plug interface.

In a further embodiment, an electrical connector assembly is provided. The electrical connector assembly includes a circuit board having an upper surface and a lower surface. The circuit board has circuit conductors at the upper surface. The electrical connector assembly includes an electrical connector including a connector housing and power contacts held by the connector housing. The connector housing has a mating end and a mounting end. The mating end is configured to be mated with a mating connector. The mounting end is mounted to the upper surface of the circuit board. Each power contact extends between a mating end and a terminating end. The mating end includes a power-in contact interface configured to be coupled to the mating connector.

The terminating end includes a power-out circuit board interface coupled to the corresponding circuit conductors of the circuit board. Each power contact includes a power take-off between the mating end and the terminating end. The power take-off includes a power-out cable plug interface configured to be electrically connected to a cable plug. The electrical connector assembly includes a power take-off cable plug coupled to the electrical connector. The power take-off cable plug includes a plug housing holding a power take-off terminal. The power-take-off terminal is coupled to the power contact at the power-out cable plug interface. The power take-off cable plug includes a power cable coupled to the power take-off terminal and extending from the plug housing.

DETAILED DESCRIPTION OF THE INVENTION

Figure 1:
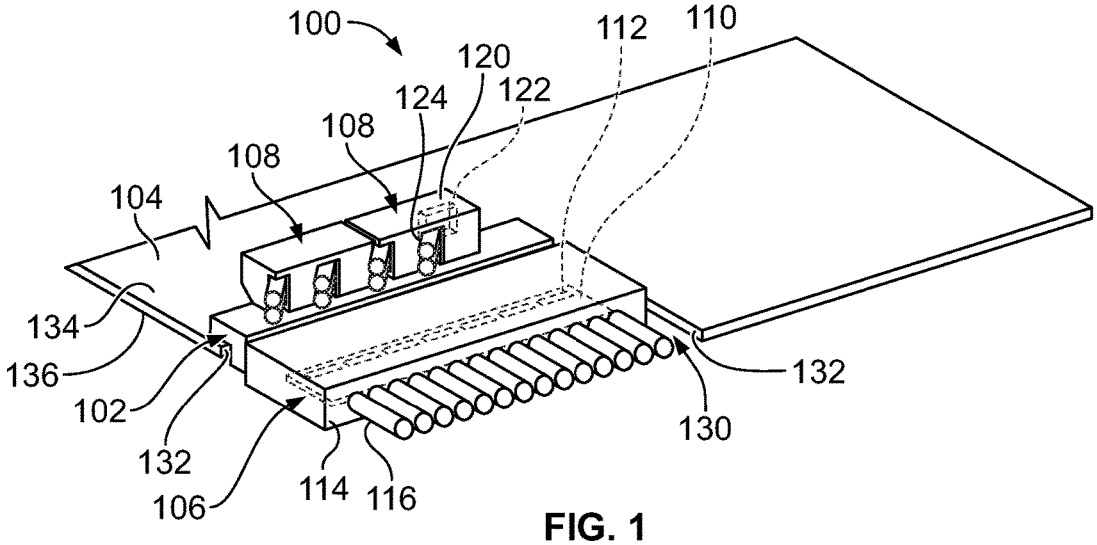
FIG. 1 illustrates an electrical connector assembly in accordance with an exemplary embodiment.

FIG. 1 illustrates an electrical connector assembly 100 in accordance with an exemplary embodiment. The electrical connector assembly 100 includes an electrical connector 102 mounted to a circuit board 104. The electrical connector assembly 100 includes a mating connector 106 mated with the electrical connector 102. In an exemplary embodiment, the electrical connector assembly 100 includes one or more power takeoff cable plugs 108 coupled to the electrical connector 102. In an exemplary embodiment, the electrical connector 102 in the mating connector 106 are power connectors used to supply power to the circuit board 104. The cable plugs 108 are used as power takeoff components used to supply power to other components within the electrical connector assembly 100. The power takeoff cable plugs 108 are coupled directly to the electrical connector 102 rather than being coupled to the circuit board 104. As such, the number of connection interfaces with the circuit board 104 are reduced. The size of the circuit board 104 may be reduced by moving the power takeoff location to the electrical connector 102 rather than from the circuit board 104. Alternatively, surface area on the circuit board 104 may be used for other components rather than connection interfaces for the power takeoff cable plugs 108.

In an exemplary embodiment, the mating connector 106 is a plug connector in the electrical connector 102 is a receptacle connector. For example, the electrical connector 102 may include a slot or receptacle to receive a portion of the mating connector 106. In various embodiments, the electrical connector 102 may be a card edge connector having a card slot configured to receive a circuit card of the mating connector 106. In the illustrated embodiment, the mating connector 106 includes a mating card 110 (shown in phantom) having mating contacts 112. Optionally, the mating contacts 112 may be provided on opposite sides of the mating card 110, such as the top side and the bottom side of the mating card 110. For example, the mating contacts 112 may be formed by circuit traces of the mating card 110. The mating connector 106 includes a mating connector housing 114 holding the mating card 110. A power cable 116 extends from the mating connector housing 114. The power cable 116 is electrically connected to the mating contacts 112, such as through the mating card 110. In alternative embodiments, the mating connector 106 may be provided without the mating card 110. For example, individual mating contacts 112 may be held in the mating connector housing 114 and terminated directly to the power cable 116. The mating contacts 112 may be blade contacts, tab contacts, spring beam contacts, or other types of power contacts. Other types of mating connectors 106 may be provided in alternative embodiments.

In an exemplary embodiment, the power takeoff cable plugs 108 are removably coupled to the electrical connector 102. For example, the power takeoff cable plugs 108 may include separable mating interfaces. The power takeoff cable plug 108 includes a plug housing 120 holding power takeoff terminals 122. One or more power cables 124 extend from the plug housing 120. The power cables 124 are electrically connected to the power takeoff terminals 122. For example, the power takeoff terminals 122 may be crimped or soldered to the power cables 124. In an exemplary embodiment, the power takeoff terminals 122 are socket terminals. In alternative embodiments, the power takeoff terminals 122 may be blade terminals or pin terminals. In an exemplary embodiment, the power takeoff cable plug 108 is low-profile. For example, the plug housing 120 may be relatively short and the power cables 124 may exit the plug housing 120 from a side of the plug housing 120 such that the power cables 124 do not add height to the power takeoff cable plug 108. For example, the power cables 124 may exit in a direction parallel to the circuit board 104.

In an exemplary embodiment, the circuit board 104 includes a cutout 130 that receives the electrical connector 102 and the mating connector 106. The cutout 130 is defined by one or more edges 132 of the circuit board 104. The electrical connector 102 is coupled to the circuit board 104 at the edge 132. Optionally, a portion of the electrical connector 102 and a portion of the mating connector 106 extend through the cutout 130 such that a portion of the electrical connector 102 and the mating connector 106 extend through the circuit board 104. Optionally, a portion of the electrical connector 102 and the mating connector 106 may be located above an upper surface 134 of the circuit board 104 and a portion of the electrical connector 102 and the mating connector 106 may be located below a lower surface 136 of the circuit board 104. By recessing the electrical connector 102 and the mating connector 106 in plane with the circuit board 104 and overall height or profile of the electrical connector assembly 100 may be reduced.

Figure 2:
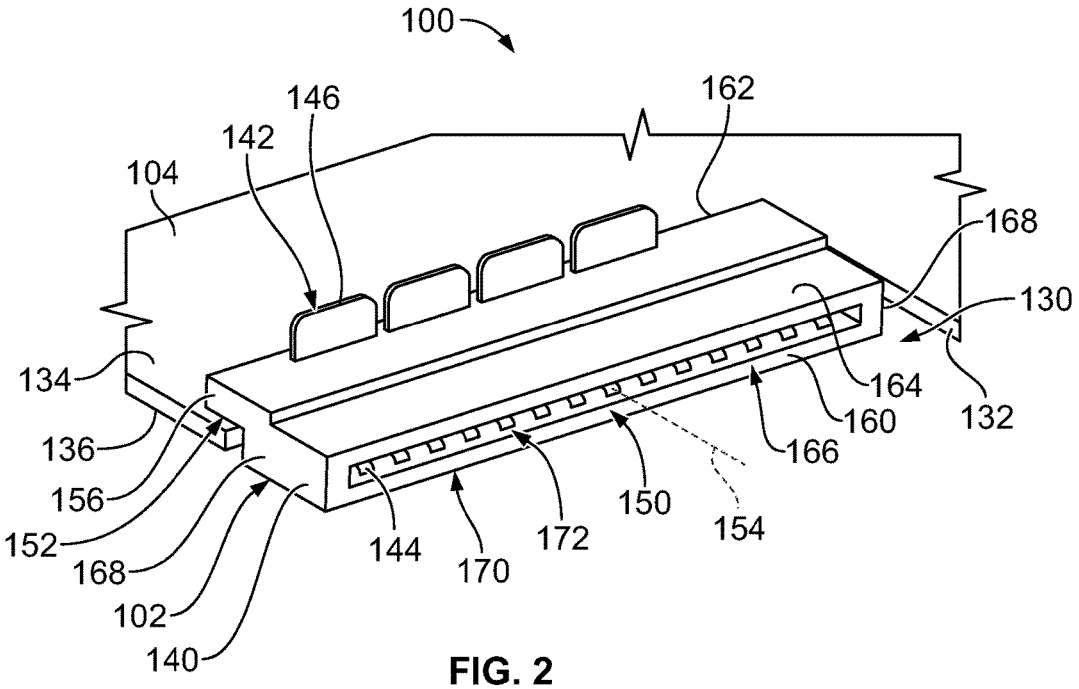
FIG. 2 is a perspective view of a portion of the electrical connector assembly showing the electrical connector mounted to the circuit board in accordance with an exemplary embodiment.

FIG. 2 is a perspective view of a portion of the electrical connector assembly 100 showing the electrical connector 102 mounted to the circuit board 104. The electrical connector 102 includes a connector housing 140 holding a plurality of power contacts. In an exemplary embodiment, the electrical connector 102 includes upper power contacts 142 and lower power contacts 144. The upper power contacts 142 are configured to interface with corresponding mating contacts 112 (shown in FIG. 1) at a top side of the mating card 110 in the lower power contacts 144 are configured to interface with corresponding mating contacts 112 and a bottom side of the mating card 110. The upper and lower power contacts 142, 144 are arranged in an upper row and a lower row, respectively that are vertically spaced apart to receive the mating card 110 therebetween. In alternative embodiments, the electrical connector 102 may be provided with a single row of power contacts, such as the upper power contacts 142 without the lower power contacts 144.

In an exemplary embodiment, the upper power contacts 142 include power takeoffs 146 extending from the connector housing 140. The power takeoffs 146 are configured to interface with the power takeoff cable plugs 108 (shown in FIG. 1). The power takeoffs provide an electrical interface for the power takeoff cable plugs 108 directly from the electrical connector 102, rather than providing a separate power takeoff connector mounted to the circuit board 104.

The electrical connector 102 extends between a mating end 150 and a mounting end 152. The mating end 150 is configured to be electrically connected to the mating connector 106 (shown in FIG. 1) along a mating axis 154. In the illustrated embodiment, the mating axis 154 is parallel to the circuit board 104. Alternatively, the mating axis 154 may be perpendicular to the circuit board 104. The mounting end 152 is configured to be mounted to the circuit board 104. In an exemplary embodiment, the connector housing 140 includes a mounting base 156 at the mounting end 152. The mounting base 156 extends along a portion of the circuit board 104 and may be secured to the surface of the circuit board 104. In the illustrated embodiment, the mounting base 156 is coupled to the upper surface of the circuit board. In other various embodiments, the connector housing 140 may be a straddle mount connector housing 140 wherein the mounting base 156 is coupled to the upper surface and a lower surface of the circuit board. In various embodiments, the electrical connector 102 is a right angle electrical connector having the mounting end 152 perpendicular to the mating end 150. Alternatively, the electrical connector 102 is a pastor electrical connector having the mounting end 152 parallel to and opposite the mating end 150. In an exemplary embodiment, the power takeoffs 146 are provided proximate to the mounting end 152.

The connector housing 140 is manufactured from a dielectric material, such as a plastic material. The connector housing 140 may be a molded component, such as formed by an injection molding process. The upper and lower power contacts 142, 144 may be loaded into the connector housing 140 after the connector housing 140 is formed. In alternative embodiments, the connector housing 140 may be an overmolded component, which is overmolded over the upper power contacts 142 and/or the lower power contacts 144.

The connector housing 140 extends between a front 160 and the rear 162. The connector housing 140 includes a top 164 and a bottom 166 opposite the top 164. The connector housing 140 includes sides 168 extending between the front 160 and the rear 162 and extending between the top 164 and the bottom 166. In the illustrated embodiment, the mating end 150 is provided at the front 160 of the connector housing 140 and the mounting end 152 is provided at the bottom 166 of the connector housing 140. Other arrangements are possible in alternative embodiments, such as having the mounting end 152 at the rear 162 or having the mating end 150 at the top 164.

The connector housing 140 includes a shroud 170 extending forward of the mounting base 156. The shroud 170 is provided at the mating end 150. The upper and lower power contacts 142, 144 extend into the shroud 170. The shroud 170 surrounds a receptacle 172 of the connector housing 140. The receptacle 172 receives a portion of the mating connector 106 (shown in FIG. 1). The upper and lower power contacts 142, 144 are exposed in the receptacle 172 two interface with the mating contacts 112 of the mating connector 106. For example, the upper power contacts 142 may be provided along a top of the receptacle 172 and the lower power contacts 144 may be provided along a bottom of the receptacle 172. In the illustrated embodiment, the receptacle 172 is elongated across the width of the connector housing 140 between the sides 168. The receptacle 172 has a short height and a wide width in the illustrated embodiment. In various embodiments, the receptacle 172 defines a card slot configured to receive the mating card 110 of the mating connector 106. The receptacle 172 may have other shapes in alternative embodiments. In other various embodiments, the connector housing 140 may include multiple receptacles. For example, each receptacle may be configured to receive the corresponding mating contact 112 of the mating connector 106.

The upper power contacts 142 extend into the mounting base 156 for termination to the circuit board 104. In various embodiments, the upper power contacts 142 may be press-fit into plated vias of the circuit board 104. Alternatively, the upper power contacts 142 may be surface mounted to pads at the upper surface 134 of the circuit board 104. The upper power contacts 142 may be soldered to the pads of the upper surface. Alternatively, the upper power contacts 142 may be spring biased against the pads at the upper surface 134 at separable mating interfaces. In various embodiments, the lower power contacts 144 extend into the mounting base 156 termination to the upper surface 134 of the circuit board 104. In various embodiments, the lower power contacts 144 may be press-fit into plated vias of the circuit board 104. Alternatively, the lower power contacts 142 may be surface mounted to pads at the upper surface 134 of the circuit board 104. In other various embodiments, the connector housing 140 may include a lower mounting base (not shown) configured to extend along the lower surface 136 of the circuit board 104. The lower power contacts 144 may extend into the lower mounting base for termination to the circuit board 104 at the lower surface 136. For example, the electrical connector 102 may be straddle-mount connector straddling the edge 132 of the circuit board 104 in the cutout 130.

Figure 3:
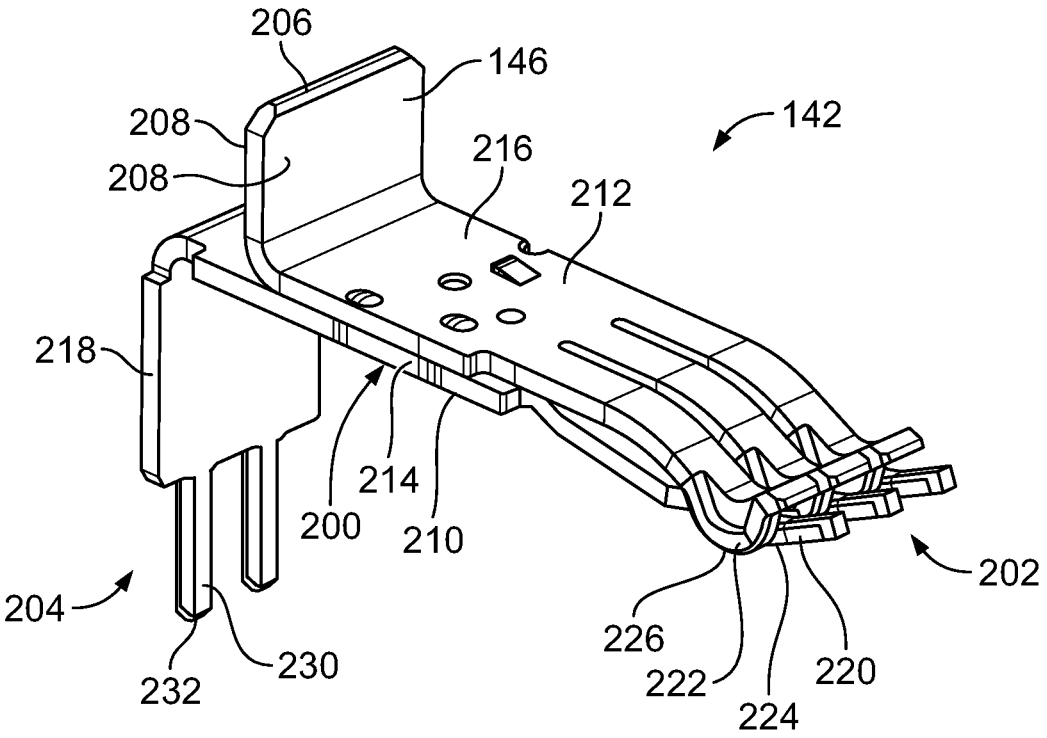
FIG. 3 is a perspective view of the upper power contact in accordance with an exemplary embodiment.

FIG. 3 is a perspective view of the upper power contact 142 in accordance with an exemplary embodiment. The upper power contact 142 includes a main body 200 extending between a mating end 202 and a terminating end 204. In the illustrated embodiment, the upper power contact 142 is a right-angle contact having the terminating end 204 perpendicular to the mating end 202. For example, the main body 200 includes a 90° bend. The upper power contacts 142 may have other shapes in alternative embodiments, such as a generally planar shape rather than having a 90° bend.

In an exemplary embodiment, the upper power contact 142 is a multipiece power contact having a first contact member 210 and a second contact member 212 separate and discrete from the first contact member 210. The first and second contact members 210, 212 are stacked in direct contact along at least a section of the upper power contacts 142. For example, the first contact member 210 includes a lower plate 214 and the second contact member 212 includes an upper plate 216. The lower plate 214 is coupled to the upper plate 216 to form a portion of the main body 200. The lower plate 214 may be welded to the upper plate 216.

In an exemplary embodiment, the first contact member 210 includes a mounting plate 218 extending from the lower plate 214. The mounting plate 218 may be oriented perpendicular to the lower plate 214. The mounting plate 218 extends to the terminating end 204.

In an exemplary embodiment, the second contact member 212 includes a power takeoff tab 206 forming the power takeoff 146 of the power contacts 142. The power takeoff tab 206 extends from the main body 200. For example, the power takeoff tab 206 may extend generally perpendicular to the upper plate 216. Optionally, the power takeoff tab 206 may have a width approximately equal to the width of the upper plate 216. The power takeoff tab 206 has a large surface area for interfacing with the power takeoff terminal 122 (shown in FIG. 1) of the power takeoff cable plug 108. In an exemplary embodiment, the power takeoff tab 206 forms a power out cable plug interface 208 configured to supply power to the power takeoff cable plug 108. The power out cable plug interface 208 is a separable mating interface allowing the power takeoff cable plug 108 to be repeatedly mated to and unmated from the power takeoff tab 206.

In an exemplary embodiment, the upper power contact 142 includes spring beams provided at the mating end 202 configured to be electrically connected to the mating connector 106. For example, the upper power contact 142 includes first spring beams 220 associated with the first contact member 210 and second spring beams 222 associated with the second contact member 212. The first spring beams 220 extend forward from the lower plate 214 and the second spring beams 222 extend forward from the upper plate 216. The spring beams 220, 222 are deflectable and configured to interface with the mating contacts 110 of the mating connector 106. In an exemplary embodiment, the spring beams 220, 222 have separable mating interfaces. In the illustrated embodiment, the ends of the spring beams 220, 222 are curved or cupped to form the separable mating interfaces. In an exemplary embodiment, the separable mating interfaces of the first spring beams 220 form first power in contact interfaces 224 configured to receive power from the mating connector 106 when mated thereto and the separable mating interfaces of the second spring beams 222 form second power in contact interfaces 226 configured to receive power from the mating connector 106 when mated thereto. The spring beams 220, 222 are configured to be mated with the mating connector 106 by a sliding or wiping mating action. The spring beams 220, 222 may be deflected when mated with the mating connector 106 to create an internal spring biasing force within the spring beams 220, 222 to maintain mechanical and electrical connection between the spring beams 220, 222 and the mating contacts 112. In an exemplary embodiment, the spring beams 220, 222 are independently movable and independently deflected when mated with the mating connector 106. In alternative embodiments, the power contacts 142 may include only the first spring beams 220 or only the second spring beams 222 rather than having both sets of spring beams 220, 222.

The upper power contact 142 includes contact tails 230 at the terminating end 204. In the illustrated embodiment, the first contact member 210 includes the contact tails 230. For example, the contact tails 230 extend from the mounting plate 218. In the illustrated embodiment, the power contacts 142 includes two contact tails 230. However, greater or fewer contact tails 230 may be provided in alternative embodiments. In an exemplary embodiment, the contact tails 230 form power out circuit board interfaces 232 configured to supply power to the circuit board 104. In an exemplary embodiment, the contact tails 230 are solder tails configured to be received in plated vias of the circuit board 104 (shown in FIG. 1) and soldered to the circuit board 104. Other types of contact tails 230 may be provided in alternative embodiments, such as press-fit pins, surface mount solder tails, and the like.

Figure 4:
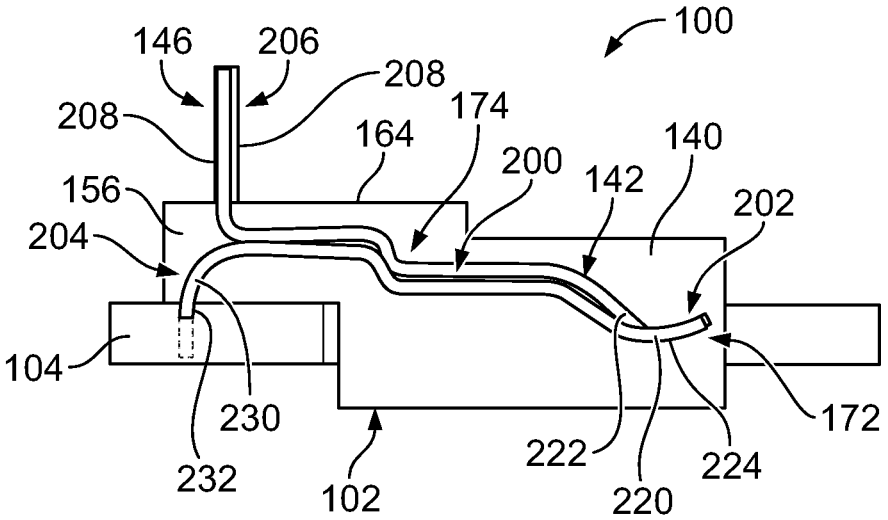
FIG. 4 is a cross-sectional view of a portion of the electrical connector assembly showing the electrical connector mounted to the circuit board in accordance with an exemplary embodiment.

FIG. 4 is a cross-sectional view of a portion of the electrical connector assembly 100 showing the electrical connector 102 mounted to the circuit board 104. FIG. 4 illustrates the electrical connector 102 without any lower power contacts 144 (shown in FIG. 2). The upper power contact 142 is arranged in a cavity 174 of the connector housing 140. The mating end 202 of the upper power contact 142 extends into the receptacle 172. The spring beams 220, 222 are deflectable in the receptacle 172 for mating with the mating connector 106 (shown in FIG. 1). The main body 200 of the upper power contact 142 extends into the mounting base 156. The terminating end 204 of the upper power contact 142 extends from the mounting base 156 for termination to the circuit board 104. For example, the contact tail 230 may extend into a plated via of the circuit board 104. The power takeoff tab 206 extends from the top 164 of the connector housing 140 to form the power takeoff 146 for the power takeoff cable plug 108 (shown in FIG. 1).

A first power path is defined between the power in contact interface 224 of the spring beam 220 and the power out circuit board interface 232 of the contact tail 230. A second power path is defined between the power in contact interface 226 of the spring beam 222 and the power out cable plug interface 208 of the power takeoff tab 206. The first power path supplies power from the mating connector 106 to the circuit board 104. The second power path supplies power from the mating connector 106 to the power takeoff cable plug 108, which is directly coupled to the electrical connector 102. The direct connection of the power takeoff cable plug 108 to the electrical to eliminates the need to route the power supply to the power take off cable plug 108 through the circuit board 104.

Figure 5:
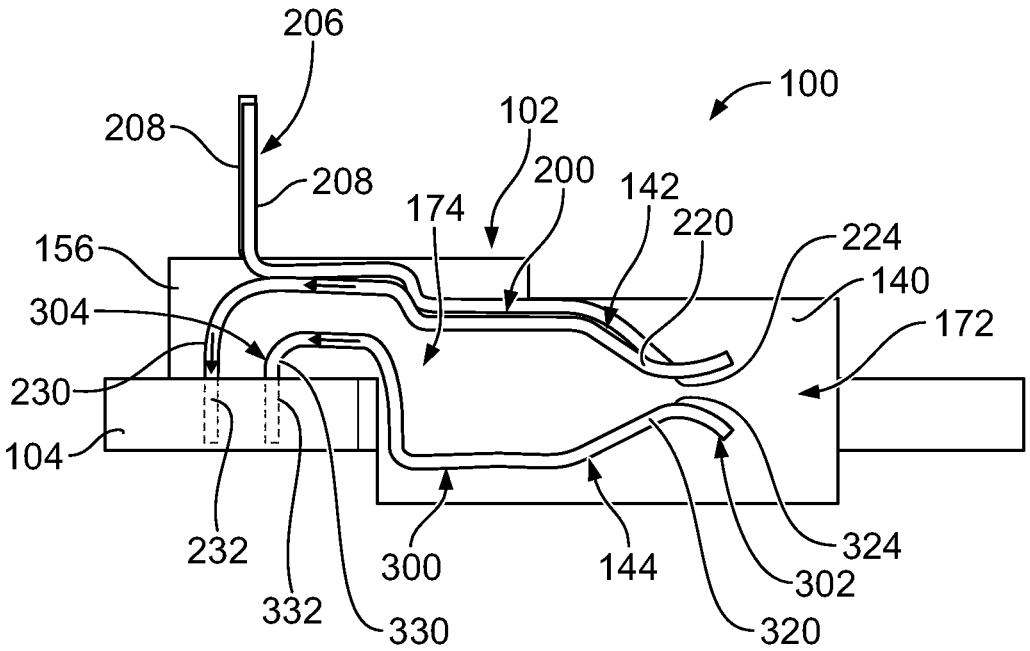
FIG. 5 is a cross-sectional view of a portion of the electrical connector assembly showing the electrical connector mounted to the circuit board in accordance with an exemplary embodiment.
Figure 6:
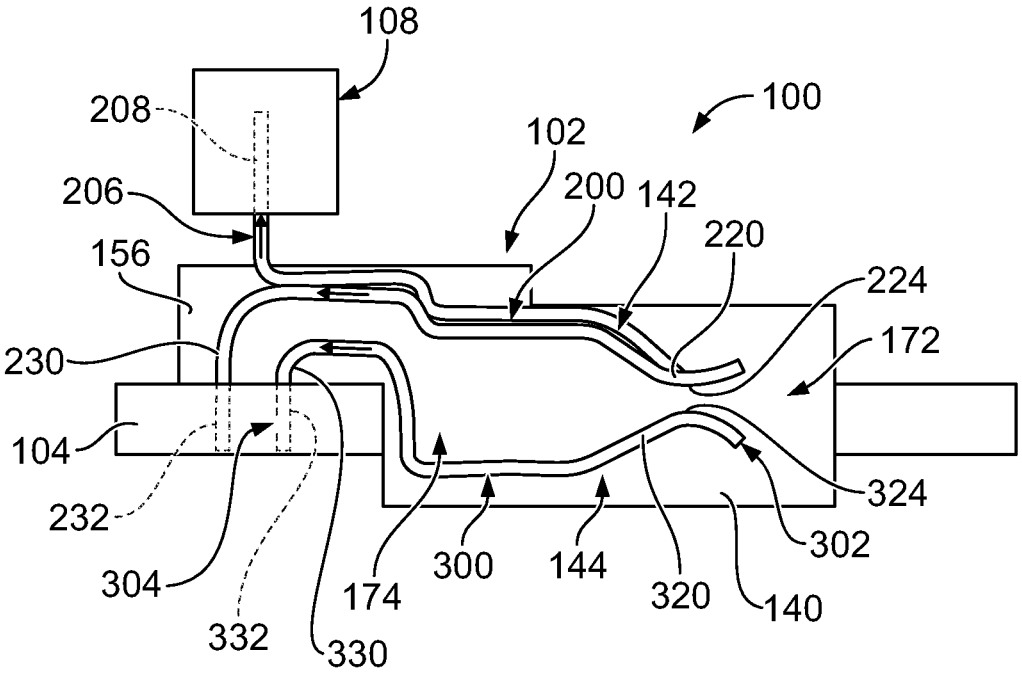
FIG. 6 is a cross-sectional view of a portion of the electrical connector assembly showing the electrical connector mounted to the circuit board in accordance with an exemplary embodiment.

FIG. 5 is a cross-sectional view of a portion of the electrical connector assembly 100 showing the electrical connector 102 mounted to the circuit board 104. FIG. 6 is a cross-sectional view of a portion of the electrical connector assembly 100 showing the electrical connector 102 mounted to the circuit board 104. FIGS. 5 and 6 illustrate the electrical connector 102 with both the upper power contacts 142 and the lower power contacts 144. FIG. 5 illustrates the electrical connector assembly 100 without any power takeoff cable plug 108 coupled to the electrical connector 102. FIG. 6 illustrates the electrical connector assembly 100 with the power takeoff cable plug 108 coupled to the electrical connector 102.

The lower power contact 144 is arranged in the cavity 174 of the connector housing 140. A mating end 302 of the lower power contact 144 extends into the receptacle 172. Spring beams 320 of the lower power contact 144 at the mating end 302 are deflectable in the receptacle 172 for mating with the mating connector 106 (shown in FIG. 1). A main body 300 of the lower power contact 144 extends into the mounting base 156 and is located below the main body 200 of the upper power contact 142. A terminating end 304 of the lower power contact 144 extends from the mounting base 156 for termination to the circuit board 104. For example, a contact tail 230 may extend into a plated via of the circuit board 104.

As shown in FIG. 5, the first power path is defined between the power in contact interface 224 of the spring beam 220 and the power out circuit board interface 232 of the contact tail 230. A lower or third power path is defined between a power in contact interface 324 of the spring beam 320 of the lower power contact 144 and a power out circuit board interface 332 of the contact tail 330 of the lower power contact 144. When the power takeoff tab 206 is open (for example, no power takeoff cable plug 108 connected to the power takeoff tab 206), then the full power supply is transferred to the circuit board 104 through the upper and lower contacts 142, 144. However, when the power takeoff cable plug 108 is coupled to the power takeoff tab 206 (FIG. 6), a portion of the power supply is transferred to the circuit board 104 and a portion of the power supply is transferred to the power takeoff cable plug 108. For example, a portion of the power supply is transferred along the second power path between the power in contact interface 226 of the upper contact 142 and the power out cable plug interface 208 of the power takeoff tab 206 in addition to the first power path and the third power path.

Figure 7:
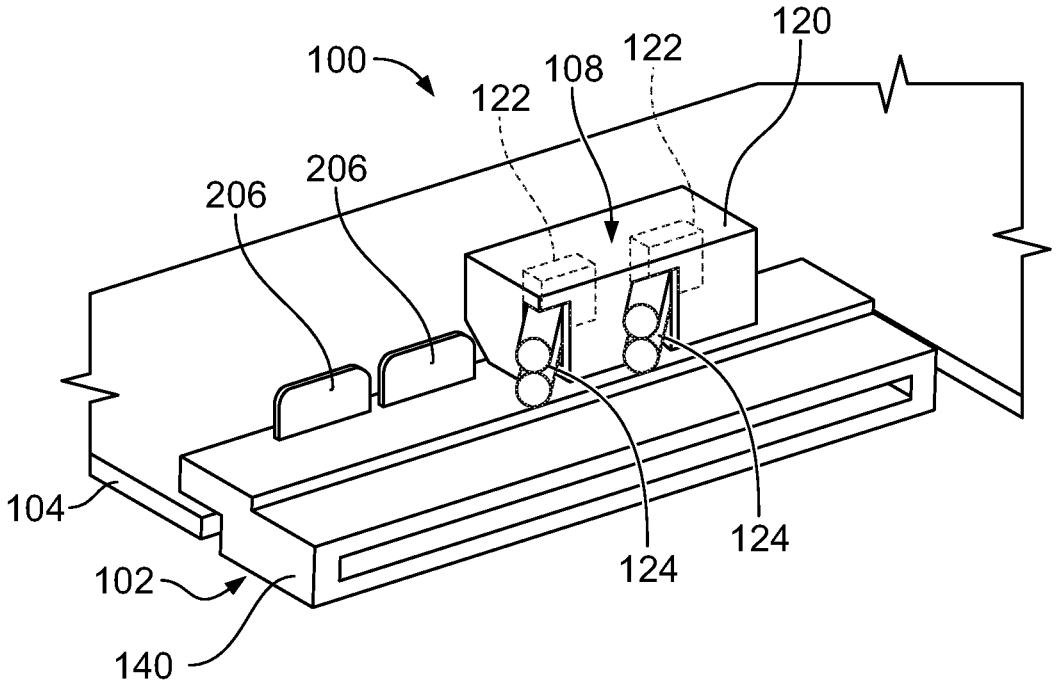
FIG. 7 a perspective view of a portion of the electrical connector assembly showing the electrical connector mounted to the circuit board in accordance with an exemplary embodiment.

FIG. 7 a perspective view of a portion of the electrical connector assembly 100 showing the electrical connector 102 mounted to the circuit board 104. FIG. 7 illustrates one of the power takeoff cable plugs coupled to the electrical connector 102 at a mounting location. Another mounting location is open. The power takeoff cable plug 108 may be removably coupled to either of the mounting locations. The plug housing 120 is configured to be coupled to the connector housing 140. Optionally, latches or other fasteners, such as threaded fasteners may be used to secure the plug housing 120 to the connector housing 140. The power takeoff terminals 122 (not shown) are configured to be coupled to the corresponding power takeoff tabs 206. For example, the power takeoff tabs 206 may be arranged in pairs defining a positive tab and a negative tab. The power cables 124 may include positive power cables and negative power cables.

Figure 8:
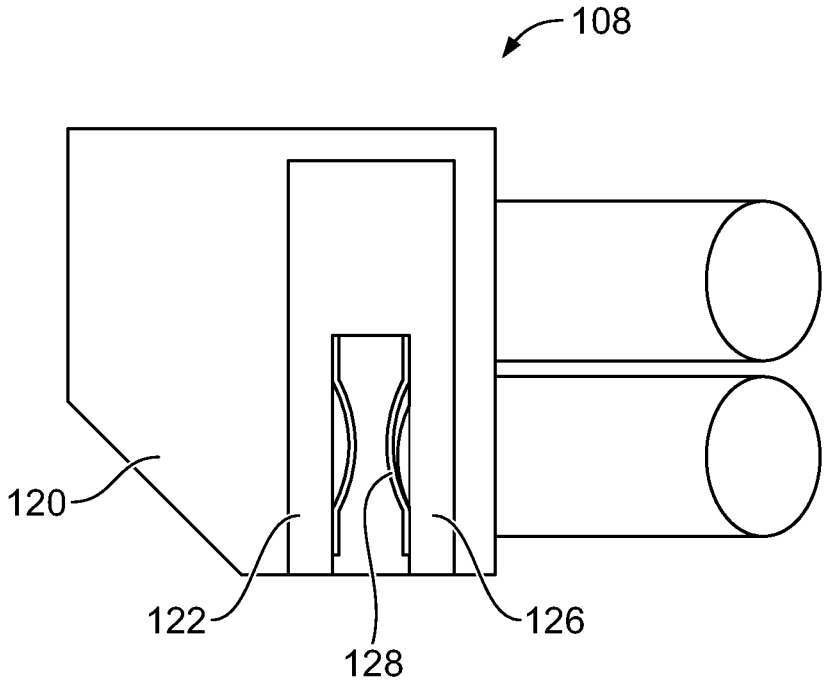
FIG. 8 is a cross sectional view of the power takeoff cable plug in accordance with an exemplary embodiment.

FIG. 8 is a cross sectional view of the power takeoff cable plug 108 in accordance with an exemplary embodiment. The power takeoff terminal 122 is located in the plug housing 120. The power takeoff terminal 122 is a socket terminal in the illustrated embodiment. In an exemplary embodiment, the power takeoff terminal 122 includes a bus bar 126 and spring contacts 128 coupled to the bus bar 126. The spring contacts 128 are arranged on both sides of the socket to engage both sides of the power takeoff tab 206 (shown in FIG. 7). Optionally, multiple spring beams may be provided on both sides of the socket. For example, the spring contacts 128 may be louvered contacts.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical connector comprising:

a connector housing having a mating end and a mounting end, the mating end including a receptacle configured to be mated with a mating connector, the mounting end configured to be mounted to a circuit board;

power contacts held by the connector housing, each power contact extending between a mating end and a terminating end, the mating end including a power-in contact interface configured to be coupled to the mating connector, the terminating end including a power-out circuit board interface configured to be coupled to the circuit board, each power contact including a power take-off between the mating end and the terminating end, the power take-off including a power-out cable plug interface configured to be electrically connected to a cable plug; and lower power contacts received in the connector housing, each lower power contact extends between a mating end and a terminating end, the mating end of the lower power contact including a power-in contact interface configured to be coupled to the mating connector, the terminating end of the lower power contact including a power-out circuit board interface configured to be coupled to the circuit board;

wherein the mating ends of each of the lower power contacts are arranged at a bottom of the receptacle and the mating ends of each of the power contacts are arranged at a top of the receptacle; and wherein the receptacle is configured to receive at least a portion of the mating connector between the power contacts and the lower power contacts for mating with the mating connector.

2. The electrical connector of claim 1, wherein each power contact includes a first power path between the power-in contact interface and the power-out circuit board interface and a second power path between the power-in contact interface and the power-out cable plug interface.

3. The electrical connector of claim 1, wherein each power contact includes a first contact member and a second contact member separate and discrete from the first contact member, the first contact member including the power-out circuit board interface, the second contact member including the power-out cable plug interface, the first and second contact members being stacked in direct contact along at least a section of the power contact.

4. The electrical connector of claim 3, wherein the first contact member includes a spring beam at the mating end and the second contact member includes a spring beam at the mating end, the power contacts being arranged in an array with the spring beams of the first contact members interspersed with the spring beams of the second contact members in a row.

5. The electrical connector of claim 1, wherein the power-out cable plug interface includes a tab configured to be received in the cable plug to mate with a corresponding power take-off terminal of the cable plug.

6. The electrical connector of claim 1, wherein the receptacle comprises a card slot configured to receive a mating circuit card of the mating connector.

7. The electrical connector of claim 1, wherein the connector housing includes a top and a bottom opposite the top, and the connector housing includes a front and a rear opposite the front, the front defining the mating end with the receptacle open at the front, the power take-offs of the power contacts including tabs defining the power-out cable plug interfaces, the tabs extending from the top of the connector housing.

8. The electrical connector of claim 7, wherein the mounting end of the connector housing is provided at the bottom of the connector housing, the terminating ends of the power contacts including tails defining the power-out circuit board interfaces, the tails extending from the bottom for electrical connection with the circuit board.

9. The electrical connector of claim 1, wherein the mating ends of the power contacts include spring beams defining the power-in contact interfaces, the spring beams extending into the receptacle for mating with the mating connector, the spring beams being deflectable against the mating connector.

10. An electrical connector assembly comprising:

a circuit board having an upper surface and a lower surface, the circuit board having circuit conductors at the upper surface;

an electrical connector including a connector housing, power contacts, and lower power contacts held by the connector housing, the connector housing having a mating end and a mounting end, the mating end having a receptacle, the mating end configured to be mated with a mating connector, the mounting end mounted to the upper surface of the circuit board, each power contact extending between a mating end and a terminating end, the mating end including a power-in contact interface configured to be coupled to the mating connector, the terminating end including a power-out circuit board interface coupled to the corresponding circuit conductors of the circuit board, each power contact including a power take-off between the mating end and the terminating end, the power take-off including a power-out cable plug interface configured to be electrically connected to a cable plug, each lower power contact extends between a mating end and a terminating end, the mating end of the lower power contact including a power-in contact interface configured to be coupled to the mating connector, the terminating end of the lower power contact including a power-out circuit board interface configured to be coupled to the circuit board, wherein the mating ends of each of the lower power contacts are arranged at a bottom of the receptacle and the mating ends of each of the power contacts are arranged at a top of the receptacle, and wherein the receptacle is configured to receive at least a portion of the mating connector between the power contacts and the lower power contacts for mating with the mating connector; and a power take-off cable plug coupled to the electrical connector, the power take-off cable plug including a plug housing holding a power take-off terminal, the power-take-off terminal being coupled to the power contact at the power-out cable plug interface, the power take-off cable plug including a power cable coupled to the power take-off terminal and extending from the plug housing.

11. The electrical connector assembly of claim 10, wherein the power contact includes a first power path between the power-in contact interface and the power-out circuit board interface and a second power path between the power-in contact interface and the power-out cable plug interface.

12. The electrical connector assembly of claim 10, wherein the power contact includes a first contact member and a second contact member separate and discrete from the first contact member, the first contact member including the power-out circuit board interface, the second contact member including the power-out cable plug interface, the first contact member includes a spring beam at the mating end and the second contact member includes a spring beam at the mating end, the power contacts being arranged in an array with the spring beams of the first contact members interspersed with the spring beams of the second contact members in a row, the first and second contact members being stacked in direct contact along at least a section of the power contact.

13. The electrical connector assembly of claim 10, wherein the power-out cable plug interface includes a tab configured to be received in the cable plug to mate with the corresponding power take-off terminal of the cable plug.

14. The electrical connector assembly of claim 10, wherein the receptacle comprises a card slot configured to receive a mating circuit card of the mating connector.

15. The electrical connector assembly of claim 10, wherein the connector housing includes a top and a bottom opposite the top, and the connector housing includes a front and a rear opposite the front, the front defining the mating end with the receptacle open at the front, the power take-offs of the power contacts including tabs defining the power-out cable plug interfaces, the tabs extending from the top of the connector housing.

16. The electrical connector assembly of claim 10, wherein the mating ends of the power contacts include spring beams defining the power-in contact interfaces, the spring beams extending into the receptacle for mating with the mating connector, the spring beams being deflectable against the mating connector.

* * * * *